US007192102B2

(12) United States Patent
Park et al.

(10) Patent No.: US 7,192,102 B2
(45) Date of Patent: Mar. 20, 2007

(54) CONTROL PANEL ASSEMBLY

(75) Inventors: Hye Yong Park, Changwon-si (KR); Dong Ha Choi, Busan (KR); Sung Rak Gong, Busan (KR); Dong In Kim, Jinju-si (KR)

(73) Assignee: LG Electronics Inc., Seoul (KR)

( * ) Notice: Subject to any disclaimer, the term of this patent is extended or adjusted under 35 U.S.C. 154(b) by 196 days.

(21) Appl. No.: 10/717,906

(22) Filed: Nov. 21, 2003

(65) Prior Publication Data

US 2004/0150303 A1 Aug. 5, 2004

(30) Foreign Application Priority Data

Nov. 28, 2002 (KR) ..... 10-2002-0074969

(51) Int. Cl.
*A47G 29/00* (2006.01)

(52) U.S. Cl. ..... 312/265.5; 312/279; 312/228

(58) Field of Classification Search ..... 312/279, 312/278, 228, 265.5, 265.6, 257.1, 236; 126/37 R, 126/39 B, 211, 50; 68/3 R, 13 R
See application file for complete search history.

(56) References Cited

U.S. PATENT DOCUMENTS 4,288,133 A * 9/1981 Deatherage ..... 312/279
4,429,817 A * 2/1984 Ikeda ..... 222/652
4,614,406 A * 9/1986 Motoi ..... 349/113
4,765,698 A * 8/1988 Dooley ..... 312/248
4,798,424 A * 1/1989 Coates et al. ..... 312/257.1
4,881,478 A * 11/1989 Sano ..... 112/259
5,603,557 A * 2/1997 Marks et al. ..... 312/265.6
5,609,703 A * 3/1997 Hamada et al. ..... 156/79
5,611,609 A * 3/1997 Katz et al. ..... 312/263
5,971,510 A * 10/1999 Lickiss et al. ..... 312/263
6,065,820 A * 5/2000 Fleissner et al. ..... 312/265.5
6,119,678 A * 9/2000 Marchand ..... 126/39 B
6,287,678 B1 * 9/2001 Spengler ..... 428/297.4
6,967,299 B2 * 11/2005 Howie et al. ..... 200/512

FOREIGN PATENT DOCUMENTS

JP 53022948 A * 3/1978

* cited by examiner

*Primary Examiner*—Peter M. Cuomo
*Assistant Examiner*—Noah Chandler Hawk
(74) *Attorney, Agent, or Firm*—McKenna, Long & Aldridge

(57) ABSTRACT

A control panel assembly of a home appliance enables a planar contact to be made during a thermal fusion of a display panel to a control panel, so that a secure adhesion between the display panel and control panel can be established regardless of design contours of the home appliance. The assembly includes a control panel having a contour according to a design of the home appliance; and a display panel attached to the control panel, wherein a planar contact between the display panel and the control panel is established through a thermal fusion technique. The display panel is provided with a triangular protrusion along rear edge, and the control panel is provided with a recess for receiving the protrusion.

11 Claims, 2 Drawing Sheets

CONTROL PANEL ASSEMBLY

This application claims the benefit of Korean Application No. 10-2002-0074969 filed on Nov. 29, 2002, which is hereby incorporated by reference.

BACKGROUND OF THE INVENTION

1. Field of the Invention

The present invention relates to a home appliance such as a washing machine, and more particularly, to a control panel assembly of a home appliance provided with an interlocking means to enable a secure attachment of a display panel to a control panel by thermal fusion.

2. Discussion of the Related Art

Major home appliances such as washing machines, driers, and dishwashers require a reliable means for the user to control the apparatus. Typically, such control is accessible from the exterior of the apparatus and includes a display panel for displaying operational status and transmitting a manual force of a user through such means as a touch screen, push-button controls, and control knobs and dials. Meanwhile, a home appliance should be aesthetically appealing, including smooth surfaces where possible.

FIGS. 1 and 2 illustrate a typical washing machine, i.e., a home appliance, provided with a control panel assembly according to a related art.

Referring to FIG. 1, an inner tub 4, having a pulsator 6 rotatably installed in its bottom, is installed in a case 2 having an entrance 2*h*. A control panel 120 is provided along a top rear edge of the case 2, adjacent a detergent box assembly 8. Built into the control panel 120 are various electronic components for controlling the operation of the apparatus, including a display device for displaying operational status and controls for transmitting a manual force from the user. The control panel 120 has a forwardly sloping upper surface to facilitate access and viewing by the user. A display panel 140, fusion-fixed to the upper surface of the control panel 120 so as to largely cover the control panel, consists essentially of a display window 141 for allowing a user to view information displayed by the display device and a plurality of controls 142 for transmitting a manual force as desired by the user.

As shown in FIG. 2, the display panel 140 has a curved rearward edge 140*b* and a sharply bent forward edge formed as a fixing rib 140*a* for fitting into a fixing recess 120*c* of the control panel 120. A pair of fusion ribs 120*a* and 120*b* are formed on the control panel 120 to protrude upward to confront the forward and rearward edges of the display panel 140, respectively, so that the display panel may be attached to an upper surface of the control panel by a thermal fusion technique using a high-frequency vibration. Hence, the display panel 140 is attached to the upper surface of the control panel 120 at the fusion ribs 120*a* and 120*b*, each of which constitute a thin line of contact between the display panel and control panel.

In the above-described control panel assembly according to the related art, however, the line of contact at the rearward fusion rib 120*b* tends to fail as the display panel 140 is vibrated to be attached to the control panel 120. As a result, adhesion of the display panel to a control panel is inadequate.

SUMMARY OF THE INVENTION

Accordingly, the present invention is directed to a control panel assembly that substantially obviates one or more of the problems due to limitations and disadvantages of the related art.

An object of the present invention, which has been devised to solve the foregoing problem, lies in providing a control panel assembly of a home appliance, by which adhesion of a display panel to a control panel is improved by providing a planar contact between the display panel and control panel.

It is another object of the present invention to provide a control panel assembly of a home appliance, which enables a secure adhesion between a display panel and a control panel regardless of design contours of the home appliance.

It is another object of the present invention to provide a control panel assembly of a home appliance, which enables a planar contact to be made during a thermal fusion of a display panel to a control panel.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided a control panel assembly of a home appliance. The assembly comprises a control panel having a contour according to a design of the home appliance; and display panel attached to the control panel, wherein a planar contact between the display panel and the control panel is established through a thermal fusion technique. The display panel is provided with a first interlocking means along one edge, and the control panel is provided with a second interlocking means for receiving the first interlocking means. The first interlocking means of the display panel is preferably achieved by a protrusion, and the second interlocking means of the control panel is preferably achieved by a recess. The protrusion and recess each have a cross-section of a corresponding shape, such as a triangle, to provide the means for interlocking.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Reference will now be made in detail to the preferred embodiment of the present invention, examples of which are illustrated in the accompanying drawings. Throughout the drawings, like elements are indicated using the same or similar reference designations where possible.

Figure 1:
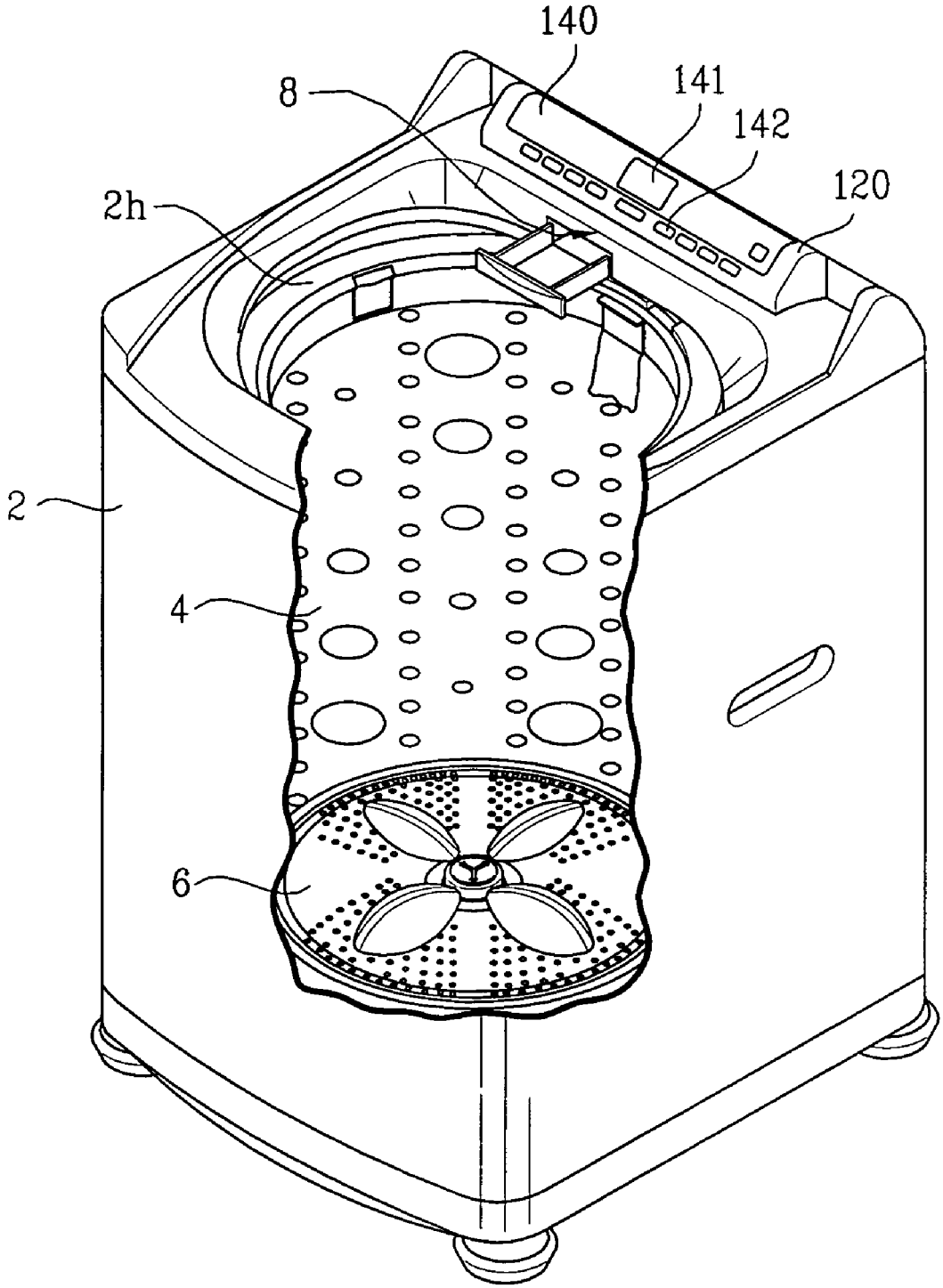
FIG. 1 Related Art
FIG. 1 is a perspective view of a general washing machine.
Figure 2:
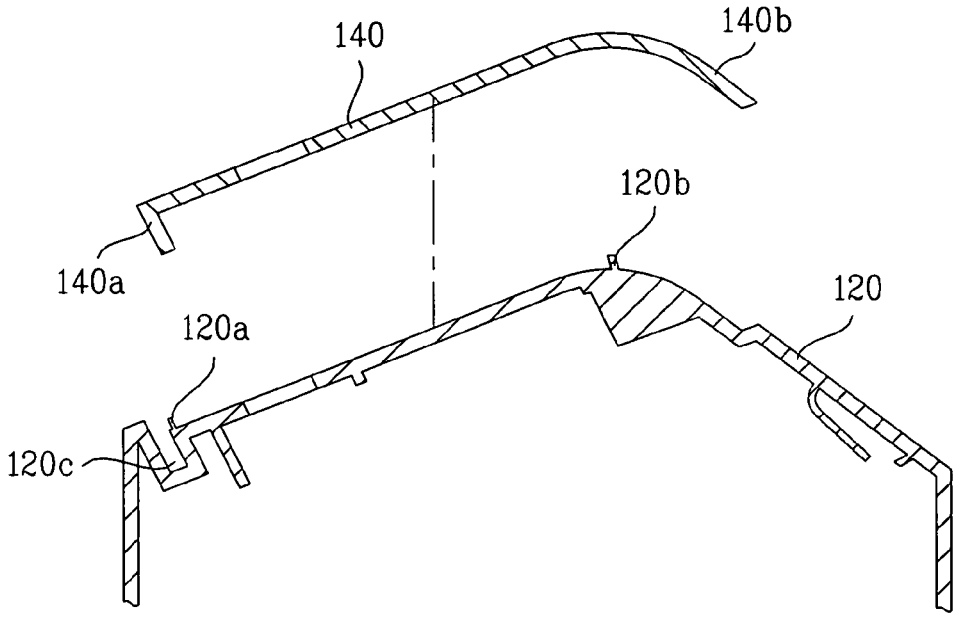
FIG. 2 Related Art
FIG. 2 is a cross-sectional view of a control panel assembly of the washing machine of FIG. 1.
Figure 3:
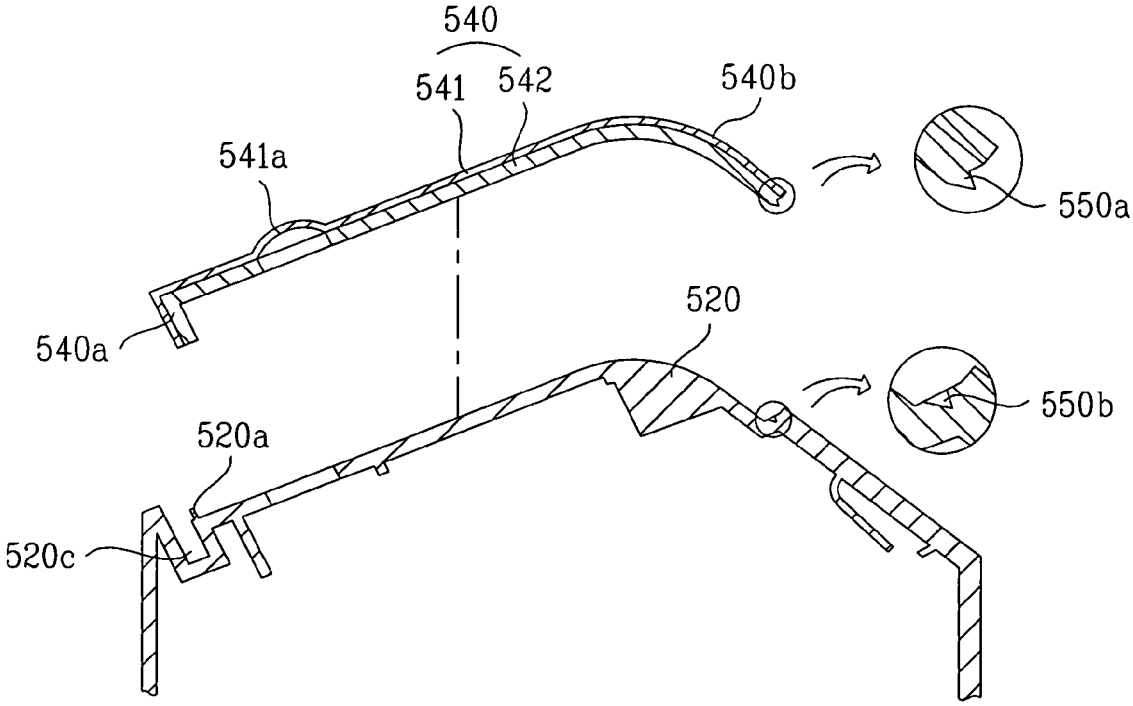
FIG. 3 is a cross-sectional view of a control panel assembly according to the present invention.

Referring to FIG. 3, a control panel assembly according to the present invention is achieved by attaching a display panel 540 to a forwardly sloping upper surface of a control panel 520. Built into the control panel 520 are various electronic components for controlling the operation of the apparatus, including a display device for displaying operational status and controls for transmitting a manual force from the user.

The display panel 540 is prepared by printing characters and symbols on an upper surface of an injection-molded fixing panel 542 and attaching a film 541, having a plurality of operational buttons 541*a* formed thereon, to the upper surface of the fixing panel. As an alternative, an operational film having operational buttons formed thereon and a print film having characters and symbols printed thereon may be attached to the injection-molded fixing panel 542.

The display panel 540 is formed by injection molding to impart a curved rearward edge 540*b* according to contours of the design of the apparatus and a fixing rib 540*a* along its forward edge, to protrude downward to fit into a fixing recess 520*c* formed in the control panel 520. A fusion rib 520*a* is formed on the control panel 520, to protrude upward toward the display panel 540 and provide a means for fusion-attachment to the display panel along its forward. The display panel 540 is provided with a fusion protrusion 550*a* formed along the tip of its rearward edge and having a triangular cross-section for fitting into a fusion recess 550*b* formed in the control panel 520.

Thus, the triangular recess of the fusion recess 550*b* of the control panel 520 is provided in opposition to the triangular protrusion of the fusion protrusion 550*a* of the display panel 540, to provide interlocking means. As an alternative, the recess may be formed in the display panel 540 such that the protrusion is formed in the control panel 520, and the recess and protrusion may have alternative cross-sectional shapes to provide the interlocking means.

In assembling the control panel assembly of the present invention, the fixing rib 540*a* of the display panel 540 is fitted in the fixing recess 520*c* of the control panel 520. Thus, the planar surface of the forward portion of the display panel 540 makes a planar contact with the control panel 520 at the fusion rib 520*a*. In doing so, the fusion protrusion 550*a* of the display panel 540 is inserted into the fusion recess 550*b* of the control panel 520, such that a planar contact is established despite the designed shape of the curved rearward edge 540*b* of the display panel. The display panel 540 is then vibrated to be attached to the control panel 520 by thermal fusion. The planar contact between the display panel 540 and control panel 520 enables an increased adhesion intensity of the display panel to the control panel.

Accordingly, regardless of the contours of a control panel of a home appliance, the control panel assembly according to the present invention achieves a secure adhesion between a display panel and the control panel.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A control panel assembly of a home appliance, the assembly comprising:

a control panel having a curved contour;

a display panel having a portion that follows the curved contour of said control panel; and a fused planar contact between said display panel and said control panel, wherein said display panel is provided with a first interlocking part along one edge and said control panel is provided with a second interlocking part that receives the first interlocking part.

2. The assembly as claimed in claim 1, wherein the first interlocking part of said display panel includes a protrusion and the second interlocking part of said control panel includes a recess.

3. The assembly as claimed in claim 2, wherein the protrusion and recess each have a triangular cross-section.

4. The assembly according to claim 1, wherein the second interlocking part is adjacent to the curved contour of said control panel.

5. The assembly according to claim 1, wherein said control panel includes an inclined portion, and wherein the contour of the display panel follows the inclined portion.

6. A control panel assembly of a home appliance, the assembly comprising:

a control panel including a portion having a nonplanar contour; and a display panel having a contour that follows the nonplanar contour of the control panel;

wherein the display panel is secured to the non-planar portion of the control panel by fused portions, said display panel is provided with a first interlocking part along one edge and said control panel is provided with a second interlocking part that receives the first interlocking part.

7. The assembly as claimed in claim 6, wherein the nonplanar contour of said control panel includes a curved contour.

8. The assembly as claimed in claim 6, wherein the first interlocking part of said display panel includes a protrusion and the second interlocking part of said control panel includes a recess.

9. The assembly according to claim 8, wherein the protrusion and the recess have triangular cross sections.

10. The assembly according to claim 6, wherein the fused portions comprise:

a protrusion disposed on an edge of the display panel that interlocks with a recess of the control panel.

11. The assembly according to claim 6, wherein said control panel includes an inclined portion, and wherein the display panel contours the inclined portion.

* * * * *